US008713979B2

(12) United States Patent
Schmid

(10) Patent No.: US 8,713,979 B2
(45) Date of Patent: May 6, 2014

(54) METHOD FOR THE OPERATION OF A COILING DEVICE USED FOR COILING OR UNCOILING A METALLIC STRIP, AND CONTROL DEVICE AND COILING DEVICE THEREFOR

(75) Inventor: Otto Schmid, Röttenbach (DE)

(73) Assignee: Siemens Aktiengesellschaft, Munich (DE)

( * ) Notice: Subject to any disclaimer, the term of this patent is extended or adjusted under 35 U.S.C. 154(b) by 1099 days.

(21) Appl. No.: 12/524,412

(22) PCT Filed: Jan. 30, 2008

(86) PCT No.: PCT/EP2008/051132

§ 371 (c)(1),
(2), (4) Date: Jul. 24, 2009

(87) PCT Pub. No.: WO2008/092896

PCT Pub. Date: Aug. 7, 2008

(65) Prior Publication Data

US 2009/0314873 A1 Dec. 24, 2009

(30) Foreign Application Priority Data

Feb. 2, 2007 (DE) ..... 10 2007 005 378

(51) Int. Cl.
*B21B 37/58* (2006.01)

(52) U.S. Cl.
USPC ..... 72/10.2; 72/11.3; 72/12.2; 72/146

(58) Field of Classification Search
USPC ..... 72/10.1, 10.2, 10.3, 11.3, 12.2, 12.3, 72/12.6, 146, 205, 148; 700/150, 153; 374/45; 33/533; 242/390.6, 390.9
See application file for complete search history.

(56) References Cited

U.S. PATENT DOCUMENTS 4,548,063 A * 10/1985 Cox ..... 72/9.4
4,872,923 A * 10/1989 Borodin ..... 148/598

(Continued)

FOREIGN PATENT DOCUMENTS

AT 408526 B 12/2001 ..... B21C 47/02
CH 442483 A 8/1967 ..... B21C 47/00

(Continued)

OTHER PUBLICATIONS

German Office Action, German application No. 10 2007 005 378.0-14, 3 pages, Aug. 8, 2007.

(Continued)

*Primary Examiner* — Edward Tolan
(74) *Attorney, Agent, or Firm* — King & Spalding L.L.P.

(57) ABSTRACT

A coiling device (1) for coiling or uncoiling a strip (2), has at least one coiler (5), an optional drive roll (7) associated with the coiler (5), and a control device (10) for the coiler (5) and the optional drive roll (7). The control device (10) operates the coiling device (1) in such a way that a current strip temperature and/or a current microstructure property of the strip is/are determined by taking measurements or calculating a model, the control device (10) determines a current desired torque value (MH,MR) from the actual value or a variable derived therefrom, and the control device (10) operates the coiler (5) and the optional drive roll (7) by the current desired torque value (MH,MR). The coiling device (1) has the advantage of improving the coiling quality as well as the strip quality in terms of the strip thickness and width.

14 Claims, 4 Drawing Sheets

(56) References Cited

U.S. PATENT DOCUMENTS

| | | | | |
|---|---|---|---|---|
| 4,905,491 | A * | 3/1990 | Starke et al. | 72/8.6 |
| 5,263,113 | A * | 11/1993 | Naitoh et al. | 388/815 |
| 5,787,746 | A * | 8/1998 | Ferreira | 72/11.3 |
| 6,263,714 | B1 * | 7/2001 | Johnson et al. | 72/9.2 |
| 6,301,946 | B1 * | 10/2001 | Kukizaki et al. | 72/148 |
| 6,378,346 | B1 | 4/2002 | Sudau et al. | |
| 6,722,173 | B2 * | 4/2004 | Broese et al. | 72/7.2 |
| 6,729,757 | B2 * | 5/2004 | Faure et al. | 374/50 |
| 8,108,064 | B2 * | 1/2012 | Mukhopadhyay | 700/150 |
| 2005/0016712 | A1 | 1/2005 | Franz et al. | |
| 2007/0276638 | A1 | 11/2007 | Borchers et al. | |

FOREIGN PATENT DOCUMENTS

| | | | | |
|---|---|---|---|---|
| DE | 198 18 207 | A1 | 10/1999 | B21B 37/54 |
| DE | 10 2004 005 919 | A1 | 9/2005 | C21D 1/00 |
| EP | 0 790 084 | B1 | 8/1997 | B21B 15/00 |
| EP | 1 180 402 | A2 | 2/2002 | B21B 37/54 |
| EP | 1 576 429 | B1 | 6/2006 | G05B 17/02 |
| KR | 2005041118 | A | 5/2005 | B21B 37/48 |
| WO | 2006002783 | A1 | 1/2006 | B21B 37/00 |
| WO | 2007031368 | A2 | 3/2007 | B65H 63/00 |

OTHER PUBLICATIONS

International Preliminary Report on Patentability, PCT/EP2008/051132, 6 pages, May 13, 2009.

International PCT Search Report, PCT/EP2008/051132, 6 pages, mailed Jun. 18, 2008.

Chinese Office Action, Application No. 200880003734.8, 10 pages, Jul. 22, 2013.

* cited by examiner

METHOD FOR THE OPERATION OF A COILING DEVICE USED FOR COILING OR UNCOILING A METALLIC STRIP, AND CONTROL DEVICE AND COILING DEVICE THEREFOR

CROSS-REFERENCE TO RELATED APPLICATIONS

This application is a U.S. National Stage Application of International Application No. PCT/EP2008/051132 filed Jan. 30, 2008, which designates the United States of America, and claims priority to German Application No. 10 2007 005 378.0 filed Feb. 2, 2007, the contents of which are hereby incorporated by reference in their entirety.

TECHNICAL FIELD

The invention relates to a method for the operation of a coiling device used for coiling or uncoiling a metallic strip, which has at least one coiler, optionally at least one driving roller associated with the coiler and a control device for the coiler, and possibly for the driving roller.

The invention also relates to a control device and a control system for a coiling arrangement used for coiling or uncoiling a metallic strip, wherein the coiling arrangement has a coiler and optionally at least one driving roller associated with the coiler. Further subject matter of the invention is a coiling device used for coiling a metallic strip, which has a coiler, optionally a driving roller associated with the coiler, and a control device for the coiler, and possibly for the driving roller. The invention also relates to a data carrier.

BACKGROUND

Coiling arrangements used for coiling a strip are generally known, such as for example from EP 0 790 084 B1 for a steel rolling mill.

Coiling arrangements are used both in hot rolling and in cold rolling, that is to say also below the recrystallization temperature. For example, a steel strip is first coiled in a hot rolling mill, sent in this coiled form to a cold rolling mill, and uncoiled again there for cold rolling. In the cold rolling mill, there may therefore be both an uncoiling coiler and, at the end of the mill, a tensioning coiler for coiling. If operating in reversing mode, i.e. if the strip moves through the cold rolling mill in both directions, there may also be a tensioning coiler on both sides. In connection with the invention, the uncoiling and coiling are both referred to below by the subsumptive term coiling.

It is also known to operate a coiler in rolling mills under speed override and with a fixed torque limit. In this case, a control device prescribes to the coiler a setpoint coiler speed and a coiler limiting moment, acting in the running direction of the strip. Similarly, the control device prescribes to a driving roller a setpoint roller speed and both a roller limiting moment acting in the running direction of the strip and a roller limiting moment acting counter to the running direction of the strip, and so the control device also operates the driving roller in a speed-controlled and moment-limited manner.

In the case of known coiling arrangements, there is the problem that variations occur in the tension of the strip. The increased tension may in this case be so great that it exceeds the yield point of the strip, that is to say leads to plastic deformations, for example constrictions, of the strip. The thickness, and in particular also the width, of the strip to be coiled may vary as a result. Loss of constant thickness and width of the strip to be wound represents a loss of quality. In AT 408 526 B there is described, for example, a method for reducing fluctuations in the tensile force during coiling, such fluctuations in the tensile force being described as being caused by instances of out-of-roundness in the region of the coiler. For correction, the respectively current tensile force and the respectively current angle of twist of the coiler are determined.

SUMMARY

According to various embodiments, the quality of the coiling, and consequently the quality of the strip, in the case of a strip coiler can be further improved.

According to an embodiment, in a method for the operation of a coiling device used for coiling or uncoiling a metallic strip, which has at least one coiler, optionally at least one driving roller associated with the coiler and a control device for the coiler, and possibly for the driving roller, a) a current microstructure property of the strip is measured or determined by model calculation as the actual value, b) a current torque value, acting in and/or counter to the running direction of the strip, is determined by the control device from the actual value or from a variable derived therefrom, and c) the control device uses the current torque value to operate the coiler and/or the driving roller.

According to a further embodiment, the strip can be a steel strip or a nonferrous strip in a rolling mill, in particular a hot rolling mill, and/or in a downstream treatment line. According to a further embodiment, the control device may continually determine torque values in such a way that a variation in the winding moment or strip tension acting in the strip is reduced, the winding moment or the strip tension preferably being constant. According to a further embodiment, the determination of the actual value may take place in real time, online and/or continuously, in particular at a rate of at least 50 measurements per second. According to a further embodiment, the control device may operate the coil and/or the driving roller in a moment-limited manner. According to a further embodiment, the determination of the actual value may take place between the coiler and the driving roller and/or directly upstream of the driving roller, and/or between the coiling system, formed by the coiler and the optional driving roller, and a rolling stand arranged upstream of the coiling system, in particular directly downstream of the rolling stand. According to a further embodiment, a grain size, a grain structure, a phase proportion, a Gibbs' free enthalpy and/or a molecular or atomic distribution can be measured or determined as the microstructure property. According to a further embodiment, a current material property of the strip can be determined from the actual value, in particular a stiffness, a tensile strength, a surface quality, a temperature, a geometric dimension, a yield point, a toughness or a ductility. According to a further embodiment, a static material property of the strip can be transferred to the control device, in particular a material type, an alloy code, information on a chemical analysis of the strip material and/or associated correction factors. According to a further embodiment, the control device may output a setpoint coiler speed to the coiler and possibly a setpoint roller speed to the driving roller. According to a further embodiment, the control device may operate the coiler and possibly the driving roller in a speed-controlled manner. According to a further embodiment, the control device may operate the coiler and possibly the driving roller in a speed-limited manner.

According to another embodiment, a control device for a coiling arrangement used for coiling or uncoiling a strip may have a coiler and optionally at least one driving roller associated with the coiler, wherein the control device may be formed in such a way that it operates the coiler, and/or possibly the driving roller, according to an operating method as described above.

According to a further embodiment, the control device may have a sensor for measuring the microstructure property of the strip. According to a further embodiment, the control device may have a model calculating unit for the model-based calculation of a current property of the strip, characterizing the microstructure of the strip, and/or for the calculation of a current strip temperature.

According to yet another embodiment, a control system for a coiling arrangement used for coiling or uncoiling a metallic strip, wherein the coiling arrangement has a coiler and optionally at least one driving roller associated with the coiler), may comprise a) a model calculating unit for the model-based calculation of a current temperature and/or a current property of the strip, characterizing the microstructure of the strip, b) a control device, which has torque calculating means to calculate a torque value from the current microstructure property or temperature of the strip, and c) at least one drive controlling device for the coiler and/or the driving roller, to which the torque value can be fed.

According to yet another embodiment, a coiling device used for coiling a metallic strip may comprise a coiler, optionally a driving roller associated with the coiler, and a control device for the coiler, and possibly for the driving roller, wherein the control device is formed as described above.

According to yet another embodiment, a coiling device used for coiling a metallic strip may have a coiler, optionally a driving roller associated with the coiler, and a control system for the coiler, and possibly for the driving roller, wherein the control system is formed as described above.

According to yet another embodiment, a data carrier may have a computer program stored on it for carrying out the operating method as described above when the operating method is loaded in the control device.

According to yet another embodiment, a rolling mill used for rolling a steel strip, in particular a hot rolling mill, may have a coiling device as described above.

BRIEF DESCRIPTION OF THE DRAWINGS

Two exemplary embodiments of a coiling device together with the associated operating method are explained in more detail below on the basis of FIGS. 1 to 4, in which.

DETAILED DESCRIPTION

Figure 1:
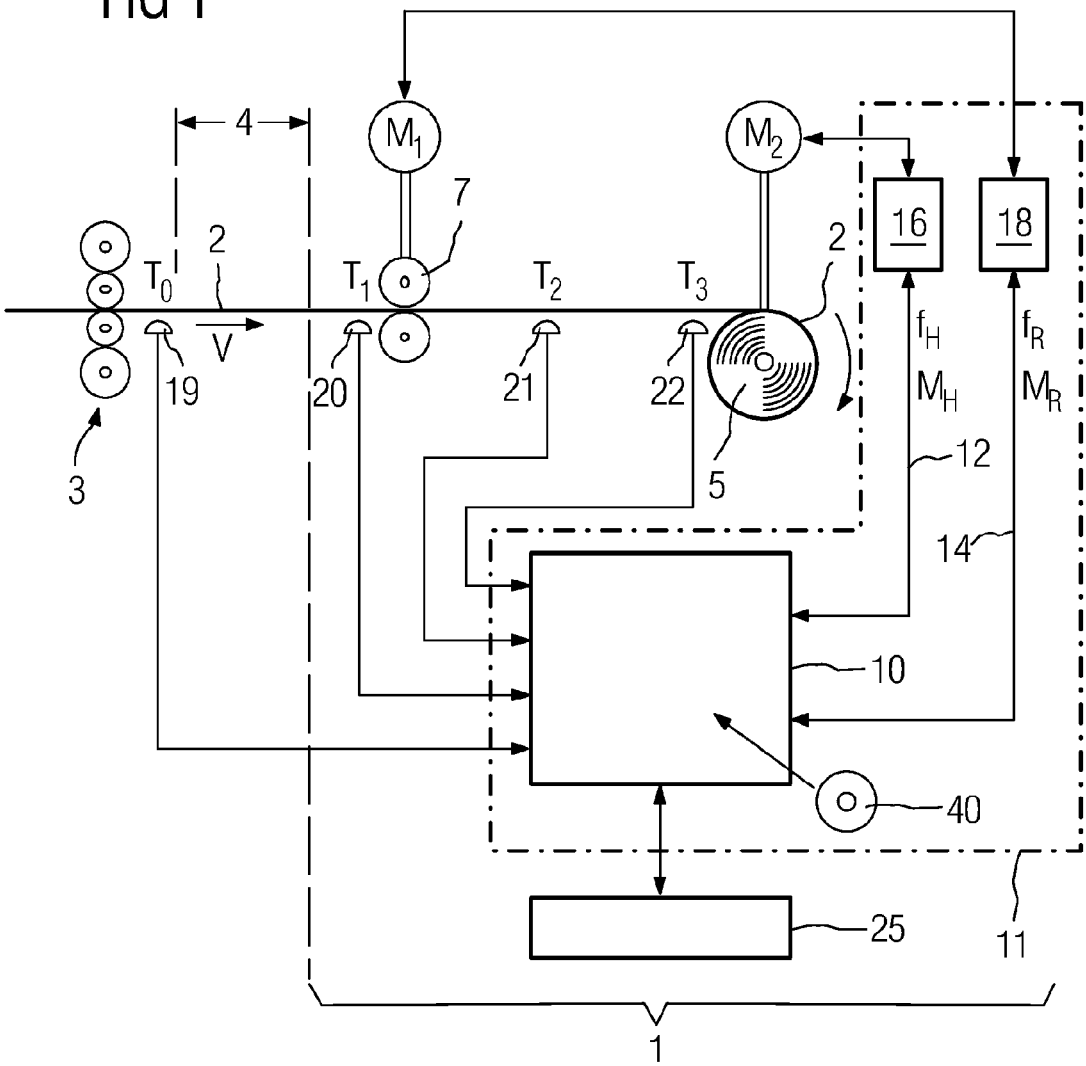
FIG. 1 shows a first exemplary embodiment of a coiling device with a number of sensors.

As described above, according to an embodiment the operating method mentioned at the beginning may have the following steps:

a) a current strip temperature and/or a current microstructure property of the strip being measured or determined by model calculation as the actual value of a current property of the strip, b) a current torque value, acting in and/or counter to the running direction of the strip, being determined by the control device from the actual value or from a variable derived therefrom, and c) the control device using the current torque value to operate the coiler and/or the driving roller.

The primary actual value can be taken as a basis for computationally deriving other actual values, which are then for their part used for determining the torque value.

The torque value may be used as a setpoint torque value and/or as a torque limiting value. For example, if the drives are operated under speed override, the two terms are to be regarded as synonymous. The optional driving roller is, in particular, arranged upstream of the coiler.

Consequently, torque-based dynamic control on the basis of current strip properties is possible. The inventors have recognized that an important characteristic for the calculation of the torque limits is the current stiffness of the strip to be wound, and that this stiffness is decisively influenced by the strip temperature and/or by the microstructure of the strip. The active adaptation of the torque calculation on the basis of actual values of the parameters that determine the stiffness of a strip over the entire winding process produces a more uniform winding moment, i.e. the moment on the material side (in the material), and consequently produces better overall winding quality and less varying, or constant strip tensions (tensile forces).

Measurement of the current tensile force or of the current angle of twist of the coiler is not obligatory for the prescribed torque selection in the case of the method according to various embodiments, but rather is irrelevant for the control concept according to various embodiments, even though under some circumstances it is advantageous for additional optional control concepts.

The new approach taken by the inventors becomes particularly clear from the variant of measuring the strip temperature. While the previous thinking in the development of rolling mills aimed at keeping the temperature in the strip constant, including during coiling, the inventors consider that the effects of temperature fluctuations are never entirely avoidable, even to the extent that temperature fluctuations are consciously accepted. It is even possible with the various embodiments for strips with temperatures varying over the length of the strip, that is to say temperature profiles or graduated cooling, for example with a hot head or end, to be deliberately rolled very exactly without any problems arising during the coiling of the strip, because, specifically in the case of such profiles with relatively great deviations between the setpoint value and the actual value, the temperature of the strip is calculated.

As an alternative or in addition to temperature measurement, a current microstructure property of the strip, in particular a grain size, a grain structure, a phase proportion, a Gibbs' free enthalpy and/or a molecular or atomic distribution, is advantageously measured or determined by model calculation. All variables that are based on the phase properties of the material of the strip, for example the grade of steel or type of alloy, are (also) suitable.

The new approach taken by the inventors likewise becomes particularly clear from the variant in which a microstructure property of the strip is determined as the actual value from a model calculation. While the previous thinking in the development of rolling mills aimed at the temperature in the strip and corresponding cooling processes, the inventors are assuming that control will in future concentrate more on the direct material properties. Corresponding modeling methods are known, for example, from EP 1 576 429 B1 or DE 10 2004

005 919 A1. They have thereby recognized that, during the coiling, that is to say coiling or uncoiling of the strip, corresponding control in dependence on the material properties concerning the microstructure is particularly advantageous.

The actual temperature value that is used for the (setpoint) torque value determination also does not have to be measured, in particular not directly in the region of the coiling device, but instead may be determined from a model calculation. This is of advantage because exact measurements of temperature or material properties of the strip are not always possible, or not without great effort, because of the ambient conditions prevailing there (heat, dirt). In particular, these measurements only provide a value at a point over the strip width, strip thickness, etc. With a model calculation it is possible to precalculate from other starting parameters, for example a temperature value or a material property directly in the region of the coiling device, for example from measured values or data obtained elsewhere in the upstream rolling mill. The model calculation may optionally (also) determine a number of, or many, values at points spatially distributed over the strip width and/or strip thickness.

The strip is in particular a steel strip or a nonferrous strip in a rolling mill and/or in a downstream treatment line, for example in a cold rolling mill of the type mentioned at the beginning. The method according to various embodiments can also be used particularly well in a hot rolling mill. It can also be used for steel strip of any alloy, but also for nonferrous metal, for example aluminum.

Preferably, the control device continually determines torque values in such a way that a variation in the winding moment or strip tension acting in the strip is reduced, the winding moment or the strip tension in the material preferably being constant. It is important that the variation in the strip is reduced, since a winding moment or strip tension acting in the strip may—but does not have to—likewise require a constant moment on the motor side or roller side.

The determination of the actual value takes place in particular in real time, online and/or continuously, for example at a rate of at least 50 or 25 measurements per second.

The control device may operate the coiler and/or the driving roller in a moment-limited manner, that is to say in particular with a respectively currently calculated torque limiting value.

The place at which, or with respect to which, the determination of the actual value takes place preferably lies between the coiler and the driving roller, and/or directly upstream of the driving roller and/or between the coiling system, formed by the coiler and the optional driving roller, and a rolling stand arranged upstream of the coiling system, in particular directly downstream of the rolling stand. The strip is at the softest directly downstream of the last rolling stand of a rolling mill; there, the thickness and width of the strip are particularly susceptible to influence, and so an actual value measurement is particularly advantageous there. A cooling section that actively and/or passively cools the strip may be arranged between the last rolling stand and the coiling system.

A material property of the strip, in particular a macroscopic material property, is preferably determined from the actual value, in particular a stiffness, a tensile strength, a surface quality, a temperature, a geometric dimension, a yield point, a toughness or a ductility.

It is also of advantage if, in addition to the respectively current and changeable values for the strip temperature and a material property, a static material property of the strip is also transferred to the control device, in particular a material type, a hot yield point as a function of the grade of steel, an alloy code, information on a chemical analysis or composition of the strip material and/or associated correction factors.

The control device preferably also outputs a setpoint coiler speed to the coiler, and/or possibly also a setpoint roller speed to the driving roller, and so the control device can preferably operate the coiler, and possibly the driving roller, in a speed-controlled manner. Speed-limited operation is also possible.

With respect to the control device, according to various embodiments, the control device can be formed in such a way that it operates the coiler, and possibly the driving roller, according to the aforementioned operating method. Advantages and preferred embodiments that are mentioned for the operating method apply analogously to the control device.

For this purpose, the control device has with particular advantage a sensor for measuring a current property of the strip, in particular a temperature sensor, and/or a model calculating unit for the model-based calculation of a current microstructure property and/or a current temperature of the strip.

With respect to the control system, according to a first variant, the control system may have the following means:

a) at least one sensor for measuring a current temperature of the strip,
b) a control device which has torque calculating means to calculate a current torque value from the current temperature of the strip, and
c) at least one drive controlling device for the coiler and/or the driving roller, to which the torque value can be fed.

The sensor is, in particular, a contactless sensor.

The sensor data are used in the control device for determining the respectively current torque value. The torque value may be used as a setpoint torque value and/or as a torque limiting value. For example, if the drives are operated under speed override, the two terms are to be regarded as synonymous.

As an alternative or in addition to the sensor, the control device or the control system has in a second variant a model calculating unit for the model-based calculation of a current property of the strip, characterizing the microstructure of the strip. Known models for the thermodynamic behavior of a material, for example so-called microstructure models and/or phase transformation models, come into consideration in particular. The model calculating unit may also determine the current strip temperature in the region of the coiling device. Also in the case of the second variant, the control system has a control device and at least one drive controlling device. Instead of the measured temperature, however, a calculated temperature or microstructure property can be fed to the control device.

Advantages and preferred configurations that are mentioned in connection with the operating method apply analogously to the control system.

With respect to the coiling device mentioned at the beginning, according to various embodiments the control device or the control system may be formed in the way described above.

A data carrier with a program code reproducing the operating method also achieves the object. Further subject matter of the invention is a rolling mill with a coiling device of the aforementioned configuration.

According to FIG. 1, a coiling device 1 is arranged downstream of a rolling mill for the hot rolling or cold rolling of a steel strip 2, the rolling mill only being shown with a last rolling stand 3 in the running-through direction and the coiling device 1 for the sake of overall clarity. The rolled strip 2 runs out of the last rolling stand 3 at a strip speed V. After running through a cooling section 4, for example with laminar cooling, which may be about 100 m long, said strip is fed to the coiling device 1 and coiled there. The length of the coiling device 1 itself is typically 5 m.

The coiling device 1 has a tensioning coiler or coiler 5, a driving roller 7, formed as a pair of driving rollers, and a control device 10. The coiler 5 has an expandable coiler drum. The driving roller 7 is arranged upstream of the coiler 5, i.e. it is arranged between the coiler 5 and the last rolling stand 3 of the rolling mill. The control device 10 activates the coiler 5 and the driving roller 7, and therefore establishes the way in which they operate and interact. It is preferably formed as a process-controlled control device 10, in which a processor device with a computer program loaded in it preferably operates. A computer program for executing the operating method according to various embodiments can be loaded into the control device 10 by means of a data carrier 40.

On the basis of the computer program, the control device 10 operates the coiler 5 and the driving roller 7 in the following way:

The control device 10 is connected via lines 12, 14 to a respective drive controlling device 16 or 18 for the driving elements or motors $M_1$, $M_2$ of the driving roller 7 or of the coiler 5. Via the first line 12, the control device 10 transfers a setpoint coiler speed $f_H$ and a current setpoint coiler torque value $M_H$, acting in the running direction of the strip, to the drive controlling device 16 for the coiler 5. Via the second line 14, the control device 10 passes a setpoint roller speed $f_R$ and a setpoint roller torque value $M_R$, acting in the running direction of the strip, to the drive controlling device 18 for the driving roller 7. Depending on the operating phase of the coiling process, the setpoint roller torque value $M_R$ may also act counter to the running direction of the strip. As an alternative to the exemplary embodiment represented here, either only the coiler 5 or only the "driver", that is to say for example the driving roller 7 or the pair of driving rollers, may be operated by the control device 10 using the respective current torque value $M_H$ or $M_R$.

In the exemplary embodiment represented, the setpoint torque values $M_H$, $M_R$ may also be understood as torque limiting values, because the drives are operated here under speed override, i.e. the speed controller never reaches its setpoint speed because the strip cannot come out of the rolling mill fast enough. This applies to the so-called fixed operation of the rolling mill, in which the strip is fixed on both sides. Arranged upstream and downstream of this normal operating phase are, respectively, an initial winding phase and an unthreading phase, in which the speed control must take place differently. The control device 10 determines the setpoint torque values $M_H$, $M_R$ automatically, actively and continuously on the basis of respectively current actual values of those "internal" parameters of the strip that determine the stiffness of the strip over the entire winding process. In the example depicted, temperature sensors 19, 20, 21, 22 acting on the basis of an optical measuring principle, for example bolometry, are present for this purpose, respectively measuring temperature values $T_0$, $T_1$, $T_2$ and $T_3$ online and continuously at various locations of the strip, to be specific between the last rolling stand 3 and the coiling system formed by the driving roller 7 and the coiler 5, here preferably directly downstream of the last rolling stand 3, furthermore directly upstream of the driving roller 7, between the driving roller 7 and the coiler 5 and directly upstream of the coiler 5. The first two temperature sensors 19, 20 ($T_0$ and $T_1$) are particularly preferred. From the respectively current temperature values $T_0$, $T_1$, $T_2$, $T_3$, the control device 10 respectively determines the setpoint torque values $M_H$, $M_R$ currently, in real time, online and continuously in such a way that a variation in the winding moment acting in the strip 2 or a strip tension is reduced or is preferably constant. This is on the basis of relationships that are known per se, for example that the stiffness decreases with increasing temperature. With increasing temperature, the torque is reduced. Measurement (actual value acquisition) and torque calculation take place with a repetition period of about 8 ms to 16 ms. Therefore, a dynamic torque limiting value formation takes place.

As an alternative to the strip temperature $T_0$, $T_1$, $T_2$, $T_3$, a current material property of the strip may also be measured—not explicitly represented. Furthermore, it is of advantage that, in addition to the dynamically variable temperature data or dynamically variable material property data, information or data on static material properties of the strip, for example the type of material etc., that is to say data that are not changed online or continually during the production of the strip, are transferred to the control device 10 from a higher-level master computer 25.

Together with the drive controlling devices 16, 18 and the temperature sensors 19, 20, 21, 22, the control device 10 forms a control system 11 for the coiling device 1.

Figure 2:
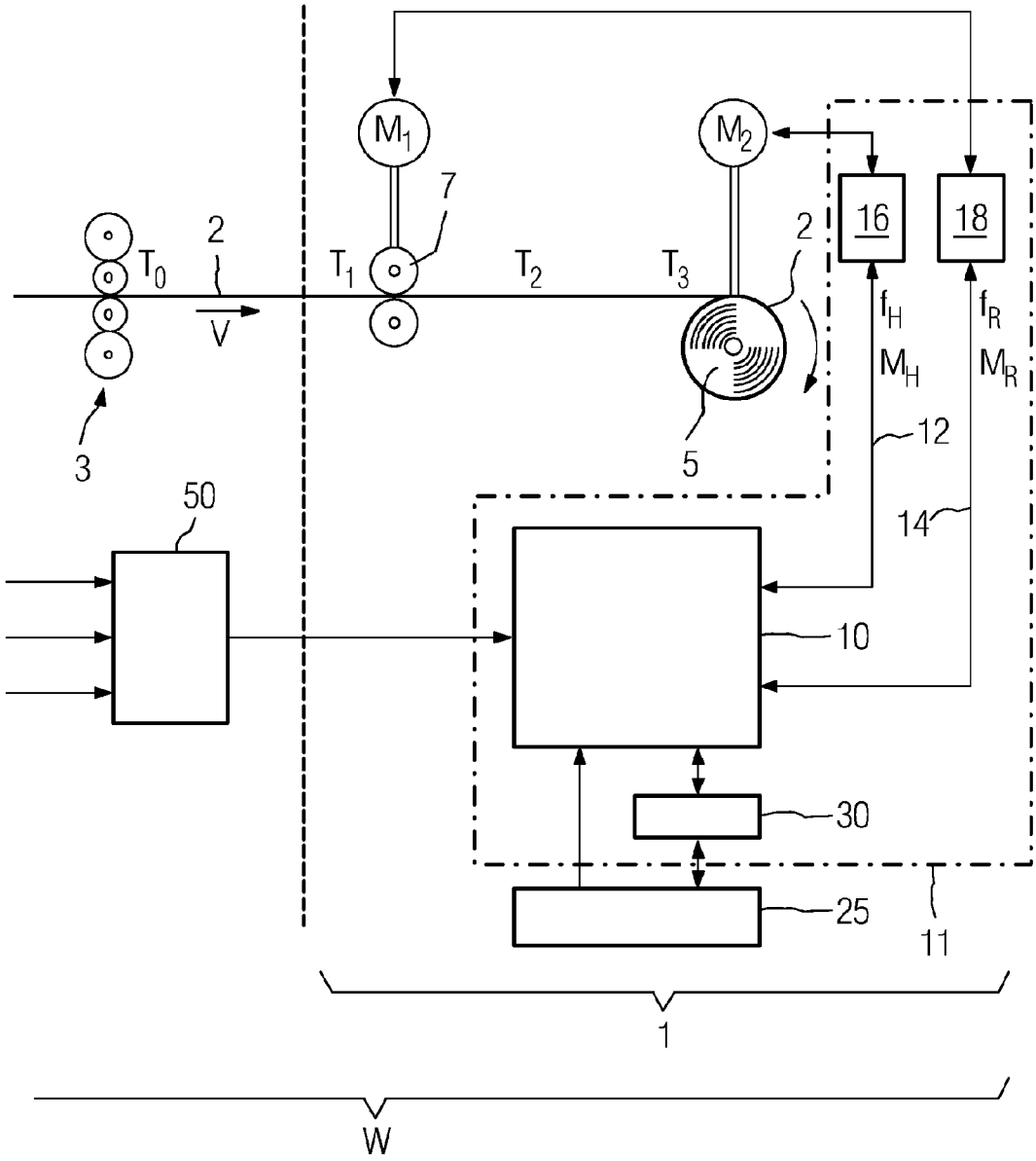
FIG. 2 shows a second exemplary embodiment of a coiling device with a model calculating unit.

The exemplary embodiment of a rolling mill W represented in FIG. 2 is identical to the exemplary embodiment represented in FIG. 1, with the difference that, instead of the temperature sensors 19, 20, 21, 22, a model calculating unit 30 is formed—for example integrated in the master computer 25—and receives input data from the master computer 25 or from another data processing unit, data acquisition unit or data input unit 50, it being possible for these data to be measured values with respect to strip temperature or a property of the strip elsewhere in the upstream rolling mill. The master computer 25 or the model calculating unit 30 are informed of the currently calculated setpoint speed and moment values via the control unit 10 for adaptation. Using relevant heat conduction equations and heat radiation laws, the model calculating unit 30 calculates the temperatures $T_0$, $T_1$, $T_2$, $T_3$ of the strip 2 in the region of the coiling device 1 and in this way fabricates actual measured values. The sensors 19, 20, 21, 22 of FIG. 1 are not absolutely necessary in this case. The measuring parameters according to the model are sent to the control device 10 for further calculation of the torques $M_H$, $M_R$.

The model calculating unit 30 may, as an alternative or in addition, calculate actual values of macroscopic material properties, for example stiffness, toughness, ductility, surface, tensile strength, or of microscopic material properties, for example grain structure, grain size, distribution of phases, Gibbs' free enthalpy etc., at any desired locations. Here it is possible to rely on the modeling methods known per se, as described for example in EP 1 576 429 B1 or DE 10 2004 005 919 A1. The model calculating unit 30 may in this case calculate in real time, or at least adequately quickly for strip control, a variable which acts as a measure of the current microstructure of the strip that cannot be directly acquired with this speed. For example, the hot yield point (abbreviated to HYP), measured in $N/mm^2$, is used as a measure of the stiffness of the strip.

Consequently, a combination of the exemplary embodiments of FIGS. 1 and 2 is also meaningful:

- measurement of the temperatures $T_0$, $T_1$, $T_2$, $T_3$ or of other material state variables at the locations shown in FIG. 1 by sensors 19, 20, 21, 22 and
- calculation of a material property, in particular a microstructure property, by the model calculating unit 30 at the same (or other) locations.

The various embodiments are based on an active adaptation of the torque calculation based on actual values of the respective parameters that determine the stiffness of the strip 2 over the entire winding process, to be specific the strip temperature and material properties reflecting the microstructure of the strip. In this case, a current model calculation, also including a microstructure calculation with respect to the material property, may also be used as the actual value. The advantage lies in a more uniform winding moment, i.e. pulling moment on the material side (in the material), and consequently leads to better winding quality and more constant strip tensions. According to various embodiments, the torque calculation, and consequently the prescribed torque selection for the coiler motors $M_1$, $M_2$ is based on actual values and current strip properties, and not on prescribed setpoint selections that remain unchanged during the winding process. As a result, the disadvantages of prescribed setpoint selections that remain unchanged during the winding process, to be specific the deviations arising between the setpoint value and the actual value that adversely influence the winding quality, are avoided. The quality of the wound strip, such as for example constant thickness and width, is improved.

As an alternative to a model calculation, the actual microstructure value may be determined by direct measurement, for example by means of X-ray diffraction.

Figure 3:
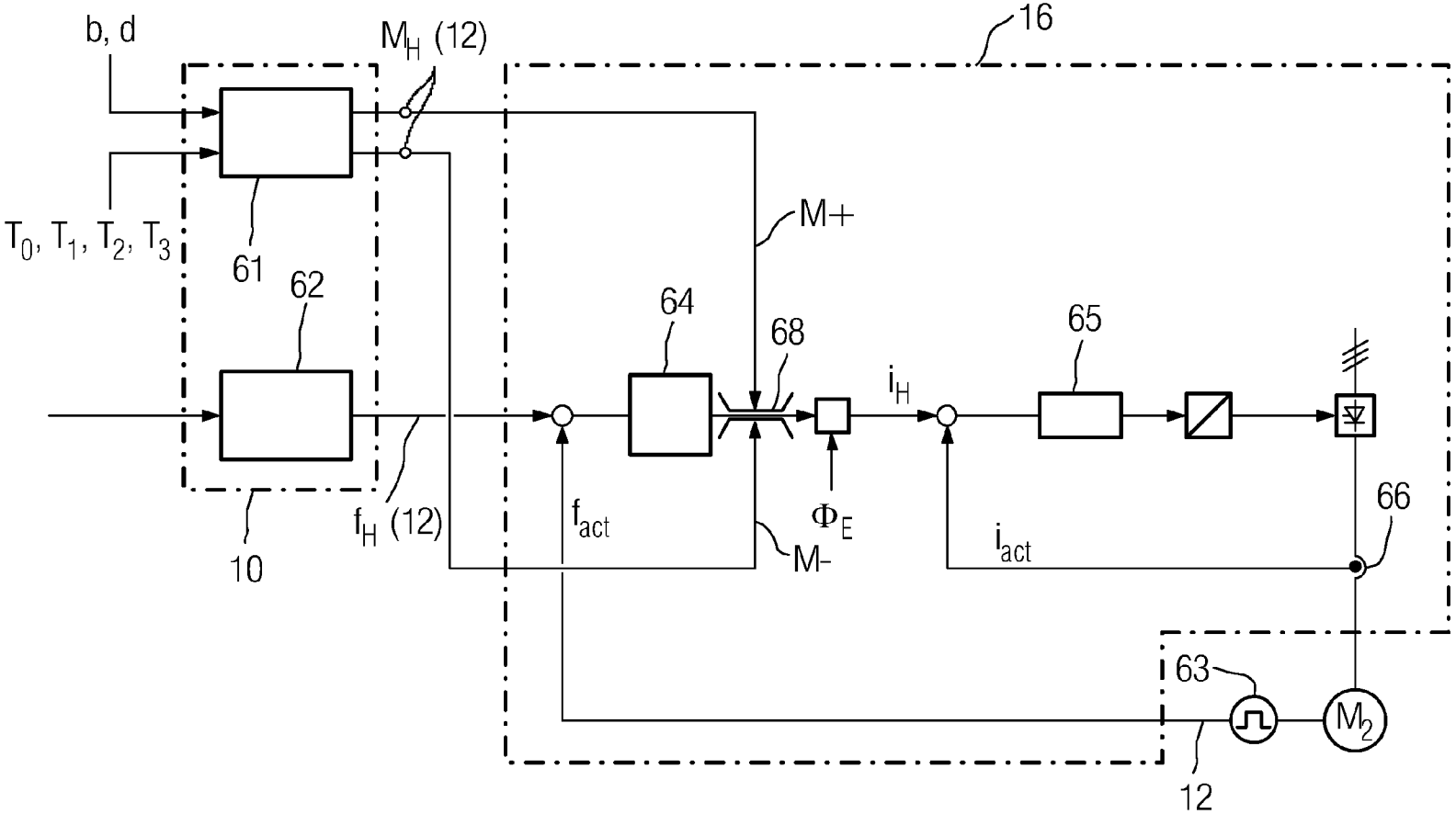
FIG. 3 shows details of the interaction of a control unit with a drive controlling device in the example of the coiler drive of the aforementioned exemplary embodiments (analogous for alternative driving roller drive)

FIG. 3 shows details of the construction of the control unit 10 and of the drive controlling device 16 of the coiler drive and their interaction. This description of the figure applies analogously to the alternative or additional driving roller drive.

The control unit 10 receives—for example from the master computer 25—the so-called set-up strip data, in particular the desired strip thickness d and strip width b. Furthermore, it receives the values that reflect the current strip properties, that is to say, for example, measured values for the temperatures $T_0$, $T_1$, $T_2$, $T_3$ or values calculated or simulated by the model calculating unit 30 for the material properties or for the current microstructure of the strip 2. The data and values enter a torque calculating module 61, which calculates the setpoint torque value $M_H$.

Furthermore, a speed calculating module 62 of the control unit 10 calculates the setpoint coiler speed $f_H$ in dependence on the winding phase prescribed by the master computer 25. Winding phases for a coil that is to be produced are, in particular, "initial winding" (starting phase), "fixed state" (operating phase) and "unthreading" (end phase). The setpoint coiler speed $f_H$ for the coiler motor $M_2$ is fed via the line 12 to a closed-loop speed control circuit. Typical values lie in the range from 500 to 1000 revolutions per minute. To form the closed-loop control circuit, associated with the coiler motor $M_2$ is a revolutions counter 63, the measured current speed $f_{act}$ of which serves as a controlled variable for calculating the system deviation "$f_{act}-f_H$" for a speed controller 64 formed in the drive controlling device 16. The output value of the speed controller 64 is a torque value, which after recalculation via the motor flux $\Phi_E$ becomes a setpoint coiler motor current $i_H$. The setpoint coiler motor current $i_H$ serves as an input variable for a current controller 65, which is likewise formed in the drive controlling device 16. On the input side, the current controller 65 is fed a current motor current $i_{act}$, measured by an ammeter 66, as a controlled variable. The current controller 65 controls the driving current of the coiler motor $M_2$.

A further component part of the drive controlling device 16 is a torque limiting module 68, which limits the torque value determined by the speed controller 64. In the exemplary embodiment represented, it is indicated by the two arrows M– and M+ that both an upper limit and a lower limit can be fed from the torque calculating module 61 (via the line 12) to the torque limiting module 68 and the two are then referred to as the setpoint torque value $M_H$. The upper limit is used with preference for the coiler 5 and the driving roller 7, the lower limit is preferably only used for the driving roller 7, the activation and control of which can otherwise take place by analogy with the coiler 5. The upper limit is preferably used in the "fixed state", to avoid the yield point of the strip 2 being exceeded, the lower limit in the other winding phases.

The upper limit of the setpoint torque value $M_H$ is formed in the torque calculating module 61 by adding four submoments:

$$M_H=M_{H,Z}+M_{H,B}+M_{H,A}+M_{H,R}$$

The four computationally determined submoments in the example of the coiler drum are:

a) a pulling moment (torque) $M_{H,Z}$ to keep the strip 2 taut:

$$M_{H,Z}=Z\cdot D/2$$

$$\text{with } Z=S_{spec}\cdot b\cdot d\cdot kt$$

Z: coiler tension
D: (current) coil diameter
d: strip thickness
b: strip width
kt: coiler tension correction factor
$S_{spec}$: specific coiler tension b) a bending moment (torque) $M_{H,B}$ to wind the strip 2 on the coiler 5:

$$M_{H,B}=b\cdot(d^2/4)\cdot S_{spec}\cdot f_{corr}$$

$f_{corr}$: correction factor c) an accelerating moment $M_{H,A}$ for overcoming forces of inertia:

$$M_{H,A}=\left[2\cdot i\cdot J_{Fix}\cdot\frac{1}{D}+\frac{b\cdot\pi\cdot\rho}{16\cdot i}\cdot\left(D^3-\frac{D_0^4}{D}\right)\right]\cdot dV/dt$$

I: gear ratio
$J_{Fix}$: moment of inertia (motor side)
$D_0$: coiler diameter
ρ: specific density (of steel)
π: 3.14 . . .
dV/dt: acceleration d) a frictional moment $M_{H,R}$ for overcoming frictional influences. This depends on the structural design of the bearings, the lubrication and the speed and may be determined during initial operation and possibly updated later.

The specific coiler tension $S_{spec}$ changes as a function of the current strip properties. In principle, here this includes the stiffness/hardness of the strip, which is dependent on the microstructure and also on the strip temperature.

Particularly the pulling torque $M_{H,Z}$ and the bending moment $M_{H,B}$ are consequently highly dependent not only on the strip thickness d and the strip width b but also on the HYP, consequently therefore on the current strip temperature T. Depending on the requirements, just one or a number of the temperature values $T_0$, $T_1$, $T_2$, $T_3$, for example a number of averaged values, may be used for the current strip temperature T that is included in the calculation.

Consequently, the control device 10 according to various embodiments can react dynamically to changing strip temperatures and consequently ensure a largely constant winding moment in the strip 2 in the event of varying motor torque, that it to say reduce undesired fluctuations in tension and losses of strip quality. Not only periodic fluctuations in tensile force, for example caused by instances of out-of-roundness in the wound strip, can be corrected, as when correcting exclusively on the basis of strip-external parameters such as the current angle of adjustment, but also changes occurring unperiodically. Rather, in the case of the coiling method according to various embodiments, measurement of the current angle of twist of the coiler and/or driving roller and measurement of the current tensile force are not absolutely necessary for determining the setpoint value for the tension/moment, because the setpoint value is derived from the temperature and/or a microstructure property of the strip. The dynamic adaptation of the torque limits with allowance for the current temperature or microstructure ensures, for example, that the yield point is not exceeded and a good winding result is achieved with a tautly wound strip (coil).

While it was previously customary to send the specific coiler tension to the automation system during setup, that is to say before the strip is wound, from level 2 as a fixed value, though also dependent on strip properties (steel class and temperature), by contrast it is assumed in the case of the example according to various embodiments that the temperature and/or the steel properties in the microstructure is/are not constant during the winding. Therefore, no fixed value is used over the entire length of the strip, but instead the (fixed) starting value is continually corrected during winding by the measured actual strip temperature and/or the modeled microstructures. This allows, for example, graduated cooling, a mode in which the head of the strip is left hotter than the middle part of the strip, to be carried out particularly advantageously. In this case, a different pulling moment and bending moment are used for the middle part (=main part of the strip) than for the head of the strip.

Figure 4:
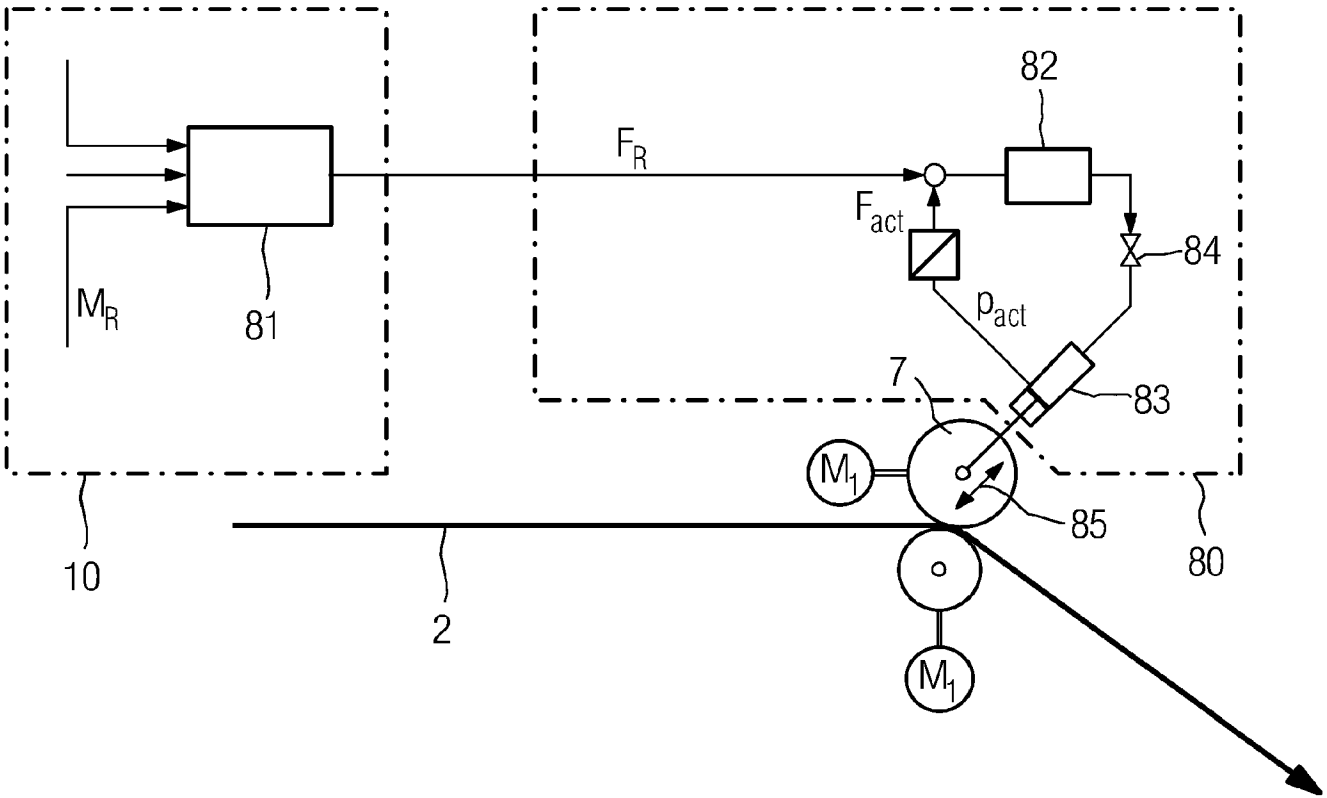
FIG. 4 shows a development of the aforementioned exemplary embodiments with the control unit interacting with a force controlling device of the driving roller(s).

Represented in FIG. 4 is a development of the aforementioned exemplary embodiments in which the control unit 10 interacts with a force controlling device or adjustment controlling device 80 of the driving roller(s) 7.

The torque limits determine the motor torque $M_R$, $M_H$ and the tension in the strip. The coiler 5 has what is virtually a positive connection with its drum and the strip generally cannot "slip".

In the case of the pair of driving rollers 7, that is to say two rollers arranged one above the other and pressed together with a force F, this positive connection does not exist and the roller can lose contact with the strip 2 and "slip through" if the driver force F is too low or the torque $M_R$ is too high. There is consequently a relationship between the setpoint roller torque value $M_R$ to be applied ("driver torque") and the setpoint driver force $F_R$.

It is consequently advantageous to use the variable of the torque value $M_R$ to set the setpoint force value $F_R$ correspondingly. In the exemplary embodiment represented, formed for this purpose in the control unit 10 is a force calculating module 81, which calculates the setpoint driver force $F_R$ from the setpoint roller torque value $M_R$ and possibly further influencing variables. The setpoint driver force $F_R$ is fed to the adjustment controlling device 80 of the driver, to be precise a force controller 82 formed therein. To form the closed-loop force control circuit, there is a hydraulic adjustment 83, which acts on the pair of rollers 7 and is influenced by the controller 82 by means of an activated valve 84. The adjusting movement is represented by the double-headed arrow 85. A measuring transducer (not represented) measures the current hydraulic pressure $p_{act}$. After recalculation into a current driver force $F_{act}$, this is fed as a controlled variable to the input of the force controller 82.

What is claimed is:

1. A method for the operation of a coiling device used for coiling or uncoiling a metallic strip, which has at least one coiler and a control system for the coiler, the method comprising:

a) measuring or calculating a current microstructure property of the strip by model calculation in real time during the coiling or uncoiling of the strip, b) determining a setpoint torque value by the control system in real time based at least in part on the measured or calculated current microstructure property of the strip, and c) adjusting at least one operational parameter of the coiler by the control system in real time based at least in part on the determined setpoint torque value, such that the at least one operational parameter of the coiler is adjusted in real time during the coiling or uncoiling of the strip based at least on the current microstructure property of the strip determined in real time during the coiling or uncoiling of the strip.

2. The operating method according to claim 1, wherein the strip is a steel strip or a nonferrous strip in a rolling mill or a hot rolling mill, and/or in a downstream treatment line.

3. The operating method according to claim 1, wherein the control system continually determines torque values in such a way that a variation in the winding moment or strip tension acting in the strip is reduced, the winding moment or the strip tension preferably being constant.

4. The operating method according to claim 1, wherein the measurement or calculation of the current microstructure property is performed online and at a rate of at least 50 measurements per second.

5. The operating method according to claim 1, wherein the control system operates at least one of the coiler and a driving roller in a moment-limited manner.

6. The operating method according to claim 1, wherein the current microstructure property is measured or calculated for a location of the strip between the coiler and a driving roller, or directly upstream of the driving roller, between the coiling system, formed by the coiler and the driving roller, and a rolling stand arranged upstream of the coiling system.

7. The operating method according to claim 1, wherein at least one of a grain size, a grain structure, a phase proportion, a Gibbs' free enthalpy, and a molecular or atomic distribution is measured or calculated as the current microstructure property.

8. The operating method according to claim 1, wherein a current material property of the strip is determined from the measured or calculated current microstructure property, wherein the current material property is a stiffness, a tensile strength, a surface quality, a temperature, a geometric dimension, a yield point, a toughness, or a ductility of the strip.

9. The operating method according to claim 1, wherein a static material property of the strip is transferred to the control system, the static material property of the strip comprising a material type, an alloy code, information on a chemical analysis of the strip material, or associated correction factors.

10. The operating method according to claim 1, further comprising providing a setpoint coiler speed to the coiler.

11. The operating method according to claim 10, further comprising operating the coiler in a speed-controlled manner.

12. The operating method according to claim 1, further comprising operating the coiler in a speed-limited manner.

13. The operating method according to claim 1, further comprising:

measuring a current coiler speed;

determining by the control system a setpoint coiler speed;

determining by the control system a coiler speed deviation based on the measured current coiler speed and the determined setpoint coiler speed; and determining by the control system the setpoint torque value in real time based at least on the measured or calculated current microstructure property of the strip and the determined caller speed deviation.

14. The operating method according to claim 1, wherein determining by the control system the setpoint torque value in real time based at least on the measured or calculated current microstructure property of the strip and the determined coiler speed deviation comprises;

determining by the control system a speed-based torque value based on the determined coiler speed deviation;

determining by the control system at least one torque limit based on the measured or calculated current microstructure property of the strip; and determining by the control system the setpoint torque value in real time based on the determined speed-based torque value and the determined at least one torque limit.

* * * * *